US006298557B1

(12) United States Patent
Gilder

(10) Patent No.: US 6,298,557 B1
(45) **Date of Patent: *Oct. 9, 2001**

(54) SAFETY RAZORS

(75) Inventor: Bernard Gilder, Twyford (GB)

(73) Assignee: The Gillette Company, Boston, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/141,436

(22) Filed: Aug. 27, 1998

Related U.S. Application Data

(63) Continuation of application No. PCT/US97/03862, filed on Mar. 10, 1997.

(30) Foreign Application Priority Data

Mar. 11, 1996 (GB) ..... 9605145

(51) Int. Cl.[7] ..... B26B 19/42
(52) U.S. Cl. ..... 30/34.2; 30/81
(58) Field of Search ..... 30/34.2, 81, 82; D28/47

(56) References Cited

U.S. PATENT DOCUMENTS

| | | | | |
|---|---|---|---|---|
| D. 175,896 | * | 10/1955 | MacMicking . | |
| D. 379,675 | * | 6/1997 | Ichiyanagia . | |
| D. 402,084 | * | 12/1998 | Chen et al. . | |
| 3,722,090 | * | 3/1973 | Dawidowicz | 30/34.2 |
| 3,797,110 | * | 3/1974 | Michelson | 30/82 |
| 4,189,832 | | 2/1980 | Harper et al. | 30/34.2 |
| 4,247,982 | | 2/1981 | Booth et al. | 30/41 |
| 4,741,103 | | 5/1988 | Hultman | 30/34.2 |
| 4,912,846 | * | 4/1990 | Yu | 30/81 |
| 5,092,042 | | 3/1992 | Miller et al. | 30/77 |
| 5,191,712 | * | 3/1993 | Crook et al. | 30/34.2 |
| 5,249,361 | * | 10/1993 | Apprille, Jr. et al. | 30/34.2 X |
| 5,416,973 | * | 5/1995 | Brown et al. | 30/84 X |
| 5,689,883 | | 11/1997 | Ortiz et al. | 30/34.2 |
| 5,711,076 | * | 1/1998 | Yin et al. . | |
| 5,903,979 | | 5/1999 | Oldroyd | 30/41 |
| 5,953,819 | * | 9/1999 | Simms et al. . | |

FOREIGN PATENT DOCUMENTS

| | | |
|---|---|---|
| 0397638 | 11/1990 | (EP) . |
| 673 449 | 7/1979 | (SU) . |
| 96/35558 | 11/1996 | (WO) . |
| 9635558 | 11/1996 | (WO) . |

* cited by examiner

*Primary Examiner*—Kenneth E. Peterson
(74) *Attorney, Agent, or Firm*—Fish & Richardson P.C.

(57) ABSTRACT

A safety razor blade unit having at least one blade with a cutting edge which is moved across the surface of the skin being shaved by a handle to which the blade unit is attached. The blade unit may be mounted detachably on the handle. The razor blade unit has a guard which defines a surface for contacting the skin in front of the blade and a cap for contacting the skin behind the blade. The skin engaging portion of the guard has spaced projections extending upwardly from a base and formed of a resiliently flexible material. At least some of the projections have cross-sections with concave sides defining a recess opening.

19 Claims, 5 Drawing Sheets

SAFETY RAZORS

This application is a continuation of PCT application No. US 97/03862, filed Mar. 10, 1997.

This invention relates to shaving devices and concerns a safety razor blade unit having at least one blade with a cutting edge which is moved across the surface of the skin being shaved by means of a handle to which the blade unit is attached. The blade unit may be mounted detachably on the handle to enable the blade unit to be replaced by a fresh blade unit when the blade sharpness has diminished to an unsatisfactory level, or it may be attached permanently to the handle with the intention that the entire razor be discarded when the blade or blades have become dulled. Razor blade units generally include a guard which defines a surface for contacting the skin in front of the blade(s) and a cap for contacting the skin behind the blade(s), the cap and guard serving important roles in establishing the so-called "shaving geometry", i.e. the parameters which determine the blade orientation and position relative to the skin during shaving. The present invention is especially concerned with the guard and/or cap of a razor blade unit.

It is known to provide a skin engaging guard or cap with surface configurations intended to produce pleasant tactile sensations during shaving, for example, as described in U.S. Pat. No. 5,191,712.

The present invention aims to provide an improved surface structure on a cap or guard and in accordance with this object the invention resides in a safety razor blade unit having at least one elongate blade and a skin engaging member defining a surface for contact with the skin during shaving, said surface being defined by spaced projections extending upwardly from a base and formed of a resiliently flexible material whereby the upper ends of the projections can deflect under forces encountered during shaving, at least some of the projections having cross-sections with concave sides so oriented that the recess formed by the concave side is open towards the direction in which the blade is moved across the skin during shaving, over at least a major part of the width of the recess.

Conveniently, the concave faces of the projections face the direction in which the blade unit is moved across the skin surface although they can be inclined to this direction at an angle of up to around 45°.

Various cross-sectional shapes for the projections are possible, but a concavo-convex shape, in particular a circular arc with a circumferential extent from ¼ to ¾ of a complete circle, preferable a semicircular arc, is expedient. An alternative cross-sectional form has an arcuate medial portion extended by straight portions, such as in the shape of a letter U.

Conveniently, the projections are arranged in one or more rows e.g., 3 or 4 rows, extending along the base generally parallel to the blade, with at least ten projections in each row, and possibly up to about 40 projections in each row for a blade unit of usual length, such as on a base around 30 mm in length. Suitably, the height of the projections above the base is in the range of 0.38 mm to 1.5 mm, preferably about 0.75 mm, the thickness (measured between the concave and convex faces) is in the range of 0.10 mm to 0.50 mm, preferable about 0.17 mm, and the base thickness (the thickness where the projections join the base) to height ratio of the projections is in the range of from 1:1 to 1:15, preferably about 1:4.4.

In the case of concavo-convex projections which in cross-sections are shaped as circular arcs or include portions of such shape, the outside diameter may be in the range of 0.3 mm to 3.0 mm, preferably around 0.75 mm, and the inside diameter may be in the range of 0.1 mm to 2.5 mm, preferably about 0.4 mm. The inside and outside diameters may increase away from the base so that the projections are flared upwardly, or they can reduce away from the base so that the projections taper towards their free ends, in either case the thickness remaining constant over the height of the projection. The thickness can also vary over the height of the projections, such as due to the internal diameter gradually increasing away from the base and/or the outside diameter gradually reducing away from the base.

The spacing between the projections in the direction perpendicular to that in which the blade unit is moved over the skin during shaving, is preferably at least 0.1 mm and not greater than the width of one projection in said direction, a most preferred spacing being around 0.25 mm. If desired, adjacent projections can be interconnected by membranes moulded integrally with the projections.

With a razor blade unit according to the invention, the skin contacting surface of the skin engaging member is highly responsive to local forces, e.g. due to a projection being encountered by a hair. The concave faces of the projections can act to funnel hairs into their recesses in order to encourage interaction with the projections. In addition these faces may serve to scoop and trap moisture from the skin and release that moisture when subsequently encountering and interacting with a hair. Furthermore, the non-linear force-deflection characteristic of the concavo-convex projections can be of advantage in their interaction with hairs.

Some embodiments of the invention are described in more detail below with reference to the accompanying drawings in which.

FIGS. 7(*a*) to 7(*f*) are plan views showing alternative shapes for the projections of the skin engaging member; and FIGS. 8(*a*) to 8(*f*) are sectional views showing alternative forms for the projections.

Figure 5:
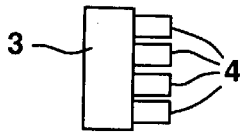
FIGS. 4 and 5 are front and end elevational views of the skin engaging member.
Figure 3:
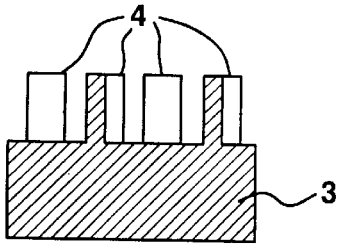
FIG. 3 is a cross-section taken along a line 3—3 in FIG. 2.
Figure 1:
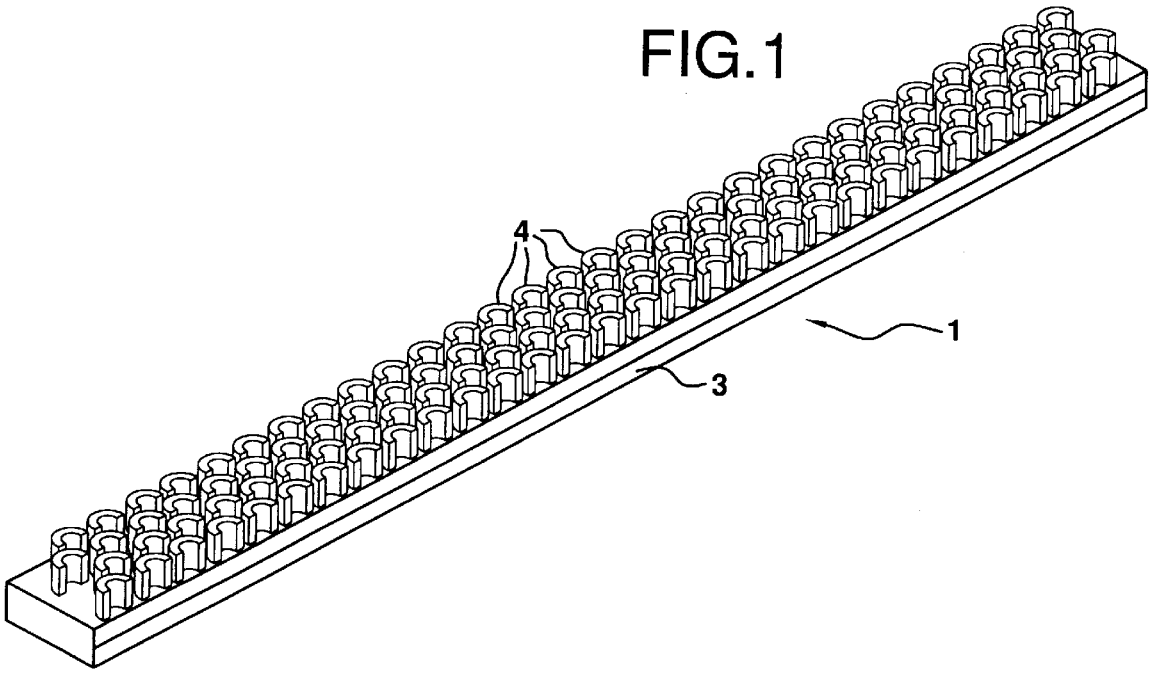
FIG.1 is a perspective view of a skin engaging member for a blade unit according to the invention.
Figure 2:
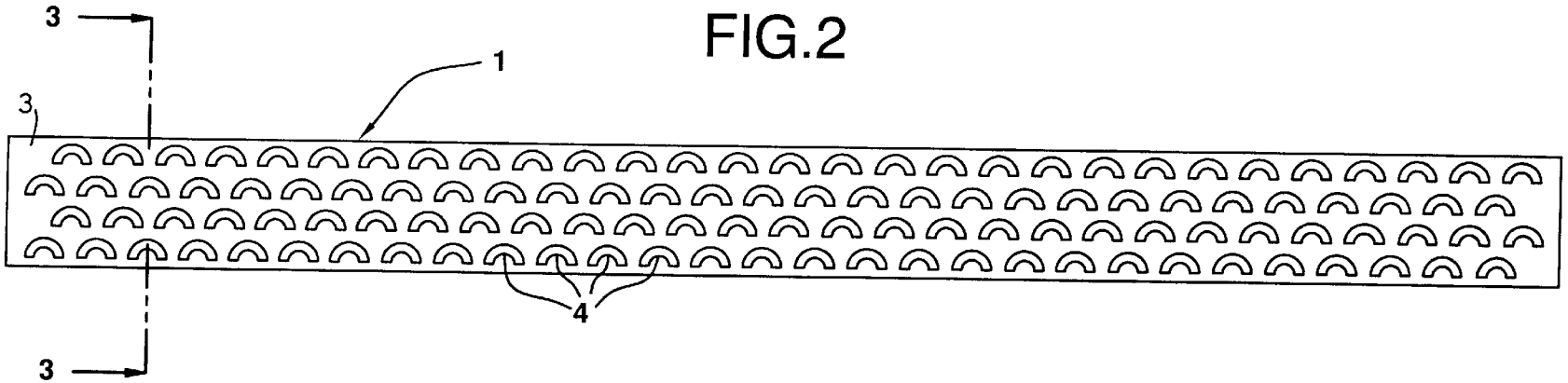
FIG. 2 is a plan view of the skin engaging member.
Figure 4:
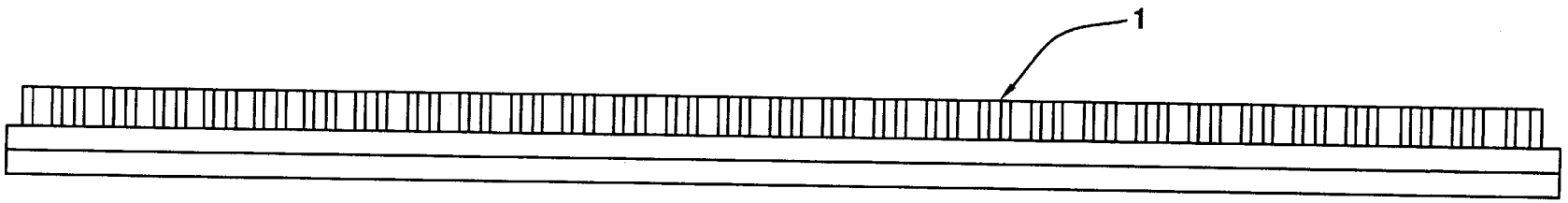
Figure 6:
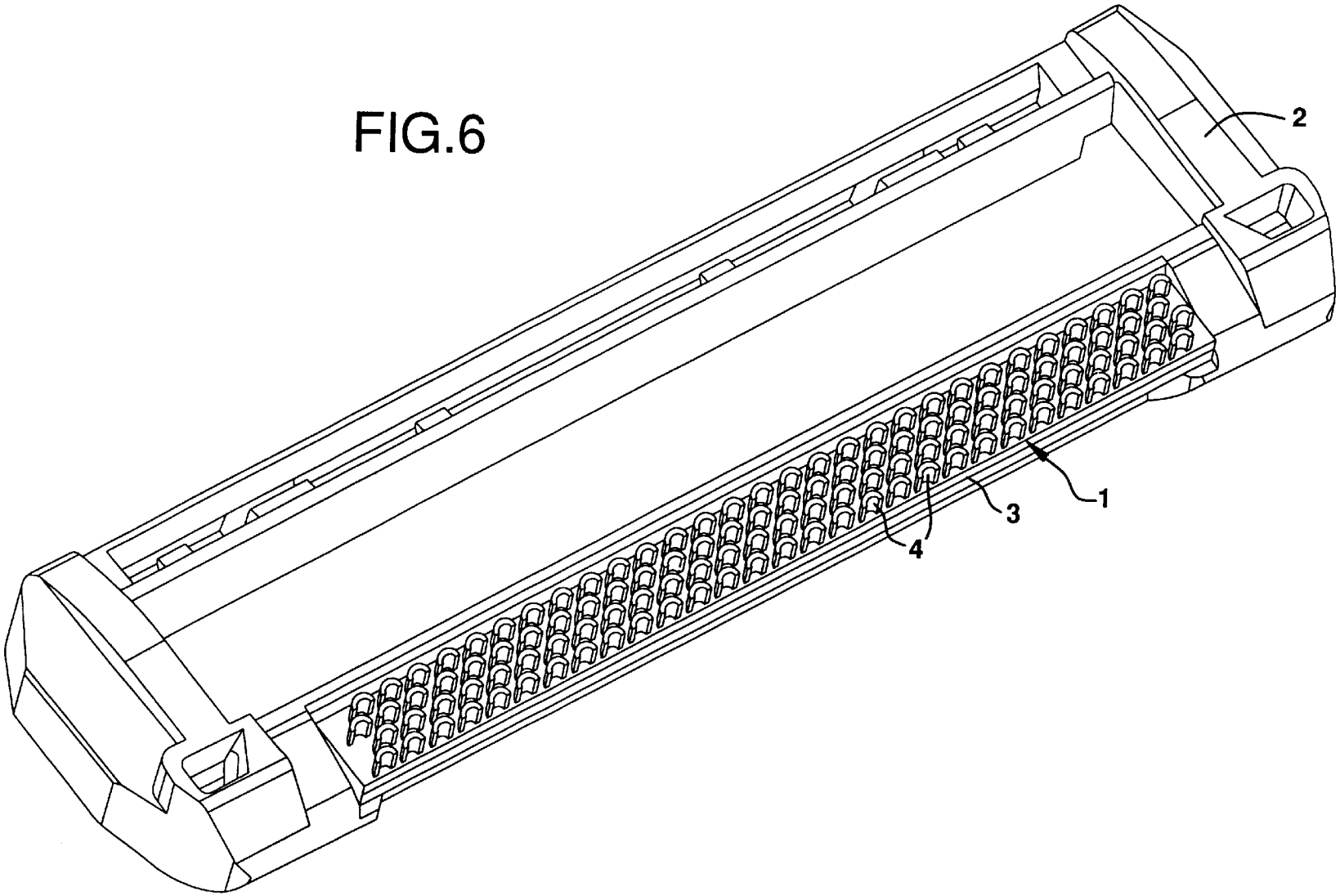
FIG. 6 shows in perspective a blade unit equipped with the skin engaging member to form the guard surface.
Figure 7F:
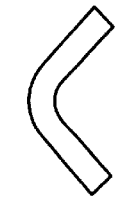
Figure 7E:
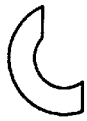
Figure 7D:
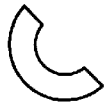
Figure 7C:
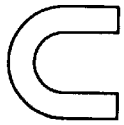
Figure 7B:
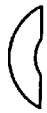
Figure 7A:
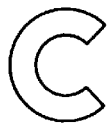
Figure 8A:
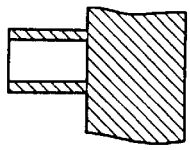
Figure 8B:
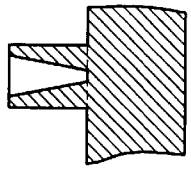
Figure 8C:
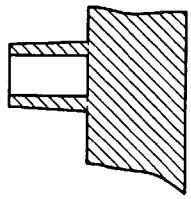
Figure 8D:
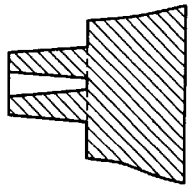
Figure 8E:
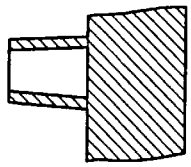
Figure 8F:
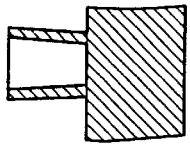

The skin engaging member 1 illustrated in FIGS. 1 to 5 is intended to form either a cap, or more appropriately a guard surface in a safety razor blade unit having one or more elongate blades. FIG. 6 shows such a blade unit equipped with the skin engaging member to define the guard surface. Although the blades of the unit have been omitted it will be understood that they will be positioned within the frame 2 of the unit so that their cutting edges are parallel to the front edge of the skin engaging member 1. The member 1 is moulded in one piece of an elastomeric material. It includes a rectangular base 3 from which extend upwardly projections 4 of semi-circular arcuate cross-section, the concave faces of these projections facing in the direction in which the skin engaging member is moved over the skin during shaving. The projections are arranged in four longitudinal rows in which the projections are equally spaced at a distance not greater than the width of the projections in the direction of the rows, and the projections of alternate longitudinal rows are longitudinally staggered by a distance which is half the centre-to-centre pitch P of adjacent projections in the same row, consequence projections of successive rows overlap in the longitudinal direction.

The dimensions are as follows:

Base length: 30 mm

Base width: 2.5 mm

Projection height 0.38 mm–1.5 mm, preferably 0.75 mm

Projection outer diameter: 0.3 mm–3.0 mm preferably 0.75 mm

Projection inner diameter: 0.1 mm–2.5 mm, preferably 0.4 mm

Projection thickness: 0.1 mm–0.5 mm, preferably 0.17 mm

Projection spacing (in each row): 0.1 mm-outside diameter, preferably 0.25 mm

Projections per row: at least 10 and 29 as shown.

In the particular embodiment shown in FIGS. 1–5, and more clearly illustrated in FIG. 8(*a*) the projections 4 are upright with a constant thickness over their height. However, they could be angled or tilted, especially forwardly and/or laterally, if preferred, and the thickness may vary over the height of the projections. It is not essential for the projections to have the described orientation and semicircular arcuate form, and some other acceptable shapes and orientations are shown in FIGS. 7(*a*) to 7(*f*). According to FIG. 7(*a*), the projection has the shape of a circular arc with a circumferential extend to ¾ of a full circle, the edges of the projection lying on respective radial planes. The shape of the projection of FIG. 7(*b*) is a circular arc, the circumferential extent of the convex face being ¼ of the complete circle and the edges lying in a common plane perpendicular to the direction of movement during shaving. A projection of U-shape is shown in FIG. 7(*c*), there being a semi-circular medial portion extended by straight portions. The projection depicted in FIG. 7(*d*) has the same shape as the projections 4 in FIGS. 1–5, but the projection is oriented on the base so that its concave face is inclined at an angle of about 45° to the forward direction. However, as in all the embodiments, the recess defined by the concave face is still open in the forward direction over the major part of the recess width. FIG. 7(*e*) shows a modified form of the projection of FIG. 7(*d*) the edges of the projection each being arranged to lie in a plane perpendicular to the forward direction. FIG. 7(*f*) shows a variation of the projection of 7(*c*), this projection having an arcuate medial portion defining a 90° bend and extended by straight portions. The dimensions mentioned above, including the inner and outer diameters and projection height and thickness, are also applicable to the skin engaging members with projections as shown in FIGS. 7(*a*) to 7(*f*).

As indicated above, the thickness of the projections 4 can vary over their height. FIGS. 8(*b*), (*c*) and (*d*) illustrate examples of projections which reduce in thickness towards their upper ends. According to FIGS. 8(*b*) this is achieved by the inner diameter gradually increasing away from the base whereas in FIG. 8(*c*) the outer diameter gradually reduces away from the base, and in FIG. 8(*d*) the inner diameter increases and the outer diameter decreases away from the base. It is also possible for the thickness to remain constant over the height of the projections while the diameters of the concave and convex surfaces change. Thus, FIG. 8(*e*) shows a projection which tapers towards its free end due to the inner and outer diameters decreasing, and FIG. 8(*f*) shows a projection which flares towards its free end due to the inner and outer diameters increasing. The embodiments of FIGS. 8(*b*) to 8(*f*) are all preferably made within the dimensional ranges specified above. Where the thickness varies it is preferably about 0.17 mm at the free upper edge of the projection, and where the outer diameter varies the maximum is preferably about 0.75 mm.

In some embodiments of the invention it may be beneficial to arrange the projections with their concave faces directed opposite to the direction in which the blade unit is moved across the skin during shaving, for example by rotating the described skin contacting members through 180° in their own planes before being mounted on the blade unit frames.

In any particular embodiment all the projections can conveniently be made with the same shape, size and orientation, but this is not strictly necessary and projections of different form and/or orientation can be combined in the same embodiment. Thus, it would be possible to have some projections oriented as in the above described embodiments with their concave faces directed forwardly in the direction of blade unit movement during shaving, and other projections reversed to face ill the opposite direction. Other modifications are also possible. For example it is not essential for projections to be separated by spaces and they can be interconnected by webs moulded integrally with the projections and base. One possibility is to have a row of projections with interconnecting webs which serve to define a continuous thin longitudinal fin which is interrupted by the projections.

The material of the skin engaging member will have a degree of flexibility appropriate for the shape and size of projections provided, but a hardness of less than 90 Shore A will normally be appropriate.

While it is apparent that modifications and changes can be made within the spirit and scope of the present invention, it is our intention, however, only to be limited by the appended claims.

What is claimed is:

1. A safety razor blade unit having at least one elongate blade and an elongated skin engaging member that is generally parallel to said blade and extends along the length thereof and defines a surface of contact with the skin during shaving, said surface being defined by spaced projections extending upwardly from a base and formed of resiliently flexible material, said projections being present on said member along substantially the entire length of said skin engaging member, whereby the upper ends of the projections can deflect under forces encountered during having, all said projections having cross-sections with concave sides so oriented that the recess formed by the concave side is open in a direction generally facing in a direction of movement of the skin engaging member during shaving over at least a major part of the width of the recess, whereby said concave sides of said projections act to funnel hairs into their respective recesses in order to encourage interaction with said projections and scoop and trap moisture from the skin and release that moisture from the skin when subsequently encountering and interacting with a hair.

2. A safety razor blade unit according to claim 1, wherein at least a major part of the width of the recess is open in an direction generally facing said direction of movement.

3. A safety razor blade unit according to claim 1, wherein the concave side faces in the direction in which the blade unit is moved over the skin during shaving.

4. A safety razor blade unit according to claim 1, wherein the projections are concavo-convex in cross-section.

5. A safety razor blade unit according to claim 4, wherein the cross-section is a circular arc with a circumferential extent of ¼ to ¾ of a complete circle.

6. A safety razor blade unit according to claim 4, wherein the projections have concave sides with a radius of curvature in the range of 0.1 mm to 2.5 mm and convex sides with a radius of curvature in the range of from 0.3 mm to 3.00 mm.

7. A safety razor blade unit according to claim 1, wherein each said projection has a substantially constant thickness around the projection from the edge at one side of the recess to the edge at the other side of the recess.

8. A safety razor blade unit according to claim 1, wherein the edges of the projection on opposite sides of the recess lie in a plane substantially parallel to the elongate blade.

9. A safety razor blade unit according to claim 1, wherein the projections are arranged on the base in a geometric pattern.

10. A safety razor blade unit according to claim 1, wherein the projections are arranged in at least one row extending along the base in a direction generally parallel to the elongate blade.

11. A safety razor blade unit according to claim 10, wherein there are at least three rows of projections and the projections in one row are longitudinally off-set with respect to the projections of an adjacent row.

12. A safety razor blade unit according to claim 11, wherein seen along a row the projections have dimensions greater than the spacing between adjacent projections.

13. A safety razor blade unit according to claim 1, wherein the projection cross-section has an arcuate portion extended by substantially straight portions.

14. The safety razor blade unit of claim 1 wherein said cross-sections of said projections have arcuate shapes.

15. A safety razor blade unit according to claim 1, wherein the thickness of the projections is substantially constant over the height of the projections.

16. A safety razor blade unit according to claim 1, wherein the height of the projections above the base is in the range of 0.38 mm to 1.5 mm.

17. A safety razor blade unit according to claim 1, wherein the thickness of the projections between the concave and convex sides is in the range of 0.10 mm to 0.5 mm.

18. A safety razor blade unit according to claim 1, where in the projections have a base thickness to height ratio in the range of 1:1 to 1:15.

19. A safety razor blade unit according to claim 1, wherein projections are shaped substantially semi-circular arcs in cross-section.

* * * * *

UNITED STATES PATENT AND TRADEMARK OFFICE

CERTIFICATE OF CORRECTION

PATENT NO. : 6,298,557 B1
DATED : October 9, 2001
INVENTOR(S) : Bernard Gilder

It is certified that error appears in the above-identified patent and that said Letters Patent is hereby corrected as shown below:

Title page,
Item [56], FOREIGN PATENT DOCUMENTS, delete "9635558 11/1996 (WO)"

Column 4,
Line 52, "an" should be -- a --

Signed and Sealed this

Thirtieth Day of April, 2002

*Attest:*

*Attesting Officer*

JAMES E. ROGAN
*Director of the United States Patent and Trademark Office*